US007849831B2

(12) United States Patent
Ono

(10) Patent No.: US 7,849,831 B2
(45) **Date of Patent: *Dec. 14, 2010**

(54) ENGINE START DEVICE FOR MANUAL WORK MACHINE, HAVING SMALL-SIZED ELECTRIC MOTOR, AND MANUAL WORK MACHINE HAVING THE START DEVICE MOUNTED THEREON

(75) Inventor: Ryou Ono, Kawagoe (JP)

(73) Assignee: Husqvarna Zenoah Co., Ltd., Saitama (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/278,048

(22) PCT Filed: Feb. 1, 2006

(86) PCT No.: PCT/JP2006/301683

§ 371 (c)(1),
(2), (4) Date: Sep. 22, 2008

(87) PCT Pub. No.: WO2007/088608

PCT Pub. Date: Aug. 9, 2007

(65) Prior Publication Data

US 2009/0020094 A1 Jan. 22, 2009

(51) Int. Cl.

| | |
|---|---|
| ***F02N 3/02*** | (2006.01) |
| ***F02N 5/02*** | (2006.01) |
| ***F02N 11/00*** | (2006.01) |
| ***F02N 15/06*** | (2006.01) |
| ***F02N 15/02*** | (2006.01) |

(52) U.S. Cl. ..... 123/179.24; 123/179.25; 123/185.14

(58) Field of Classification Search ..... 123/179.24, 123/179.25, 179.28, 185.14
See application file for complete search history.

(56) References Cited

U.S. PATENT DOCUMENTS

| | | | | |
|---|---|---|---|---|
| 3,395,687 | A | 8/1968 | Harkness | |
| 3,960,246 | A | 6/1976 | Fisher | |
| 5,083,534 | A | 1/1992 | Morishima et al. | |
| 5,115,773 | A | 5/1992 | Morishima et al. | |
| 5,163,392 | A * | 11/1992 | Morishima et al. ..... | 123/179.25 |
| 6,758,181 | B2 * | 7/2004 | Iida et al. ..... | 123/179.24 |

(Continued)

FOREIGN PATENT DOCUMENTS

| | | | |
|---|---|---|---|
| EP | 0569951 | A2 | 11/1993 |

(Continued)

*Primary Examiner*—Stephen K Cronin
*Assistant Examiner*—Anthony L Bacon
(74) *Attorney, Agent, or Firm*—McDermott Will & Emery LLP

(57) ABSTRACT

The present invention relates to a start device for a small-sized engine, which is capable of starting the small-sized engine in an appropriate starting time and is ultimately reduced in size and weight by a rational design. A plurality of secondary batteries is used as a power source required to drive a small-sized electric motor and a small-sized engine, and has a considerably large capacity and an extremely small size. A speed reduction mechanism that has a reduction ratio of 1/30 to 1/90 is disposed between the electric motor and a buffer/power storage section. The start device starts the engine in an extremely short time of 0.4 to 1.3 seconds. Within this range of staring time of the engine, an operator has no uncomfortable feelings.

2 Claims, 7 Drawing Sheets

U.S. PATENT DOCUMENTS

| | | | | |
|---|---|---|---|---|
| 7,594,490 | B2 * | 9/2009 | Ono | 123/179.24 |
| 2004/0244755 | A1 | 12/2004 | Wians | |
| 2006/0027201 | A1 * | 2/2006 | Ono | 123/179.25 |

FOREIGN PATENT DOCUMENTS

| | | | |
|---|---|---|---|
| JP | 63110672 | | 7/1988 |
| JP | 2-13171 | A | 1/1990 |
| JP | 216171 | | 1/1990 |
| JP | 2-146260 | | 6/1990 |
| JP | 2002-285940 | A | 10/2002 |
| JP | 2006077758 | | 3/2006 |

* cited by examiner

ENGINE START DEVICE FOR MANUAL WORK MACHINE, HAVING SMALL-SIZED ELECTRIC MOTOR, AND MANUAL WORK MACHINE HAVING THE START DEVICE MOUNTED THEREON

CROSS REFERENCE TO PRIOR APPLICATIONS

This application is the U.S. national phase of International Application No. PCT/JP2006/301683, filed Feb. 1, 2006, the disclosure of which is incorporated herein by reference in its entirety. The International Application was published in Japanese on Aug. 9, 2007, as WO 2007/088608 under PCT Article 21(2).

TECHNICAL FIELD

The present invention relates to battery packs mounting compact and high output batteries that drive extremely small-sized electric motors used to start small-sized engines mounted on various manual work machines such as portable bush cutters, chain saws, mowers, backpack bush cutters, power-operated spraying machines, engine blowers, dusters, and hedge trimmers, relates to engine start devices driven by the packs, and also relates to manual work machines having the engine start devices mounted thereon.

BACKGROUND ART

Most engine start devices for starting small, air-cooled gasoline engines mounted on manual work machines, such as bush cutters and chain saws, which have been used increasingly recently, include: a recoil type driving section; a driven section connected to the engine crankshaft via a disconnecting means such as a centrifugal clutch; and a buffer/power storage section disposed between the driving section and driven section, used to buffer the driving force of the driving section, and having a spiral spring or the like for elastically storing power between the driven section and itself. The recoil type driving section has: a recoil reel around which recoil rope is wound; and a recoil spiral spring disposed between the recoil reel and the casing, and fixed to the recoil reel and casing at its inside end and outside end respectively. By manually pulling out the recoil rope, the recoil reel is rotated in one direction and, simultaneously with this, the recoil spiral spring is wound tighter, thereby storing springing force. By releasing the recoil rope from the hand in this state, the power stored in the recoil spiral spring is released and the recoil rope is automatically wound back around the recoil reel.

However, the foregoing recoil type driving section requires the recoil rope to be pulled out every time the engine starts. Generally, the recoil rope must be pulled out quickly with one long stroke. The elderly people, those who are not physically strong, or people working in narrow spaces, may not be able to start the engine by pulling out the recoil rope only one time. In view of such drawbacks, there have been proposed many techniques for facilitating engine-starting operation by pulling recoil rope. Some of these have been practical to use. However, problems of inconvenience in pulling out the recoil rope still remain. On other hand, the recent development of small-sized electric motors and batteries is remarkable as they are extremely compact and have a large capacity.

In order to avoid the inconvenient operation of a recoil type start device described above, in addition to such a recent circumstance, an electric engine start device capable of easily and reliably starting the engine by the operation of a simple switch is reviewed, and further development of this type of engine start device is in demand. This type of electric, start device for small-sized engine was proposed many years ago as disclosed in Japanese Utility Model Laid-Open Publication No. 63-110672 (patent document 1). An electric start device disclosed recently is in, for example, Japanese Patent Laid-Open Publication No. 2002-285940 (patent document 2).

The start device in Japanese Utility Model Application Laid-Open No. 63-110672 includes: a DC motor driven by power supplied by a battery; a spiral spring wound up by a spring barrel driven by worm gear fixed to the output shaft of the motor; an output rotation shaft to which the inside end of the spiral spring is fixed; an engine rotation shaft connected to the output rotation shaft via a one-way clutch; a rotation lever for stopping the rotation of the output rotation shaft or for canceling the stop; a synchronizing electrical switch turned on only when the lever cancels the stop of the rotation of the output rotation shaft; and an armature current control circuit designed so that when the electric switch is turned off, the motor is driven, so that when the motor exceeds a set rotating speed, the rotation is continued to wind up the spiral spring, and so that when the spiral spring has been fully wound up and the motor consequently decreases below the set rotating speed, the supply of power and hence the rotation of the motor are stopped.

Further, the basic configuration of the start device in Japanese Patent Laid-Open Publication No. 2002-285940 (patent document 2) is substantially the same as that in the patent document 1, except that the driving side is provided with a known recoil type driving section in addition to the electric motor mentioned above. In other words, the start device in the patent document 2 is just a combination of the start device in the patent document 1 and the known recoil mechanism.

On the other hand, Japanese Patent Publication No. 2573340 (patent document 3) has disclosed a spiral spring type start device accommodating in a single frame: a battery; a DC electric motor driven by the electric power of the battery; a control device for stopping the operation of the motor; a high reduction ratio speed reduction mechanism for transmitting the power of the motor; a spiral spring type power storage device driven by the high reduction ratio speed reduction mechanism; and a power transmission device for transmitting the power in the power storage device to the crank shaft in one direction. The high reduction ratio speed reduction mechanism includes: a planetary gear system speed reduction device (in a first stage), which is disposed on an axis parallel to the crankshaft and driven by a DC electric motor; and a speed reduction device (in a second stage), in which a drive gear on the output shaft of the planetary gear system speed reduction device engages with a driven gear disposed integrally on the periphery of the springing power storage chamber of the power storage device.

Additionally, in an engine start device disclosed in, for example, Japanese Utility Model Laid-Open Publication No. 2-13171 (patent document 4), a spring barrel is supported so as to be pivotal in one direction via the supporting system of a planetary gear speed reduction device disposed opposite the engine crankshaft. The spring barrel is controlled so as to be rotated at a speed decreased by the planetary gear speed reduction device connected to the spring barrel via a combination of speed reduction spur gears, which include a large gear and a small gear fixed to the output shaft of the DC electric motor disposed in the housing. In this case, rotation in one direction is made by the engagement of a ratchet pawl with one of the teeth disposed on the periphery of the spring barrel. Disposed on the crankshaft side of the spring barrel are a starting ratchet wheel and a starting ratchet pawl. The ratchet wheel freely rotates when the wheel and pawl disengage from each other. Fitted to the starting ratchet wheel is a start device ratchet wheel, which engages with a centrifugal clutch pawl attached to the crankshaft.

The batteries used as power sources for the engine start devices disclosed in the patent documents 1 to 4 are so-called NiCad batteries or nickel metal hydride batteries. In the patent documents 1 to 4, the places where these batteries are accommodated are not specified, as is apparent from the descriptions above. Usually, such batteries are disposed in start devices as in the patent documents 3 and 4. Otherwise, due to the large volume of the entire of conventional batteries, the batteries are attached to parts specifically provided near the start devices. Further, the batteries are disposed between the engines and starting electric motors. For instance, in order to obtain, from the foregoing batteries, power required for the electric motor to wind up the spiral spring of the power storage device, a large number of NiCad batteries or nickel metal hydride batteries are needed. This limits the potential for reductions in the size and weight of the start devices.

According to the engine start device in the patent document 1, the engagement of the worm gear directly connected to the electric motor with a worm wheel formed on the periphery of the spring barrel rotates the spring barrel in one direction. This prevents reverse rotation of the spring barrel. However, in a power transmission mechanism employing the engagement of the worm gear and worm wheel, the output shaft of the electric motor is disposed perpendicular to the rotating drive shaft of the spring barrel. Such a disposition is not efficient (approximately 60%) in design, leading to an inevitable limit on possible reductions in size. Since the engine start devices in the patent documents 1 and 2 compose their speed reduction mechanisms out of the worms and worm wheels of the spring barrels, it is extremely difficult to make the entire start devices more compact.

In the patent document 3, the high reduction ratio speed reduction mechanism is disposed between the electric motor and the spring barrel, thereby reducing the motor volume and battery volume to 1/10 and 1/6, respectively, of those of a cell start device or below. Accordingly, mounting a storage battery in the start device does not hinder practical use. However, the high reduction ratio speed reduction mechanism sets an extremely high reduction ratio of 1/250 to 1/300. This is because required output torque should be ensured by an electric motor of a small size and small volume and the spiral spring should stably store power. In addition, the patent document 4 disposes the support shafts of the electric motor, spring barrel, small-diameter ratchet wheel, and ratchet pawl parallel to one another. This makes it difficult to make the engine start device more compact.

In view of the drawbacks discussed above, the applicant of the present invention has realized an engine start device ultimately reduced in size and weight by eliminating unnecessary components as in, for example, Japanese Patent Application No. 2005-196419 (patent document 5) proposed in the past by the same applicant, and by a rational design.

The basic configuration of this engine start device is as follows: the engine start device includes: a small-sized electric motor driven by a battery; a power storage section in which the power of the small-sized electric motor is drive-transmitted via a high speed reduction mechanism in the direction of force storage; and a power transmitting section that transmits the power stored in the power storage section to the engine crankshaft. The power storage section has a spring and a rotating support member that supports one end of the spring. The spring may be a spiral spring or coil spring. In the case of the spiral spring, the rotating support member may be composed of a spring barrel and, in the case of the coil spring, a normal gear can be used.

A first gear is formed on the rotating support member. A second gear is fixed to the output shaft of the high speed reduction mechanism. The first and second gears engage with each other. The engine start device has a rotation inhibiting means disposed in the power storage section or power transmitting section. The rotation inhibiting means normally permits the rotation of the power storage section or power transmitting section in the direction of release of power storage, whereas it obstructs the rotation in the direction of release of power accumulation when the electric motor is not operating. The high speed reduction mechanism is a planetary gear system speed reduction mechanism. The rotation axes of the power storage section and power transmitting section are on the same axis as the crankshaft. The rotation shafts of the small-sized electric motor and high speed reduction mechanism are parallel to the crankshaft. The spur gears of the first and second gears are engaged to each other.

This configuration has made it possible for the engine start device in the patent document 5 to overcome the above-described mechanical problems of the start devices for small-sized engine disclosed in the patent documents 1 to 4. However, the engine start device in the patent document 5 has not overcome such problems as how to drive such a small-sized engine-start mechanism smoothly, securely and safely using a compact battery. Specifically, in order to reduce both the size and weight of the entire work machine, the battery that drives the ignition circuit, fuel supply control circuit, etc., of the engine must not only simply start the engine but have a required discharging capacity and reduce the size and weight of the battery itself.

To overcome this problem, in the patent document 5, the engine start device has been developed simultaneously with a battery pack for driving the small-sized electric motor of a start device for small-sized engine as a battery for driving the small-sized electric motor. In addition to high rate lithium secondary batteries, an ordinary self-discharge prevention circuit and an over-current prevention circuit that are connected to the secondary batteries, the battery pack incorporates a protection circuit composed of electronic circuits such as an overcharge prevention circuit, over-discharge restraining circuit, and start switch relay circuit. The battery pack made more compact can be disposed integrally in the switch box of a handle separated from the engine of the manual work machine.

Patent document 1: Japanese Utility Model Laid-Open Publication No. 63-110672

Patent document 2: Japanese Patent Laid-Open Publication No. 2002-285940

Patent document 3: Japanese Patent Publication No. 2573340

Patent document 4: Japanese Utility Model Laid-Open Publication No. 2-13171

Patent document 5: Japanese Patent Application No. 2005-196419

DISCLOSURE OF THE INVENTION

Problems to be Solved by the Invention

The engine start device using the small-sized electric motor in patent document 5, which was proposed in the past by the applicant of the present invention, has ultimately reduced its size while ensuring the start of the engine. However, the range of the appropriate starting time required for the engine to start after the depression of the start switch of the small-sized electric motor, within which operators are satisfied, has been established based merely on the degree of operator satisfaction. The general objective range of appropriate starting time has not yet been established. The inventors, therefore, conducted an experiment in the range of time within which operators are satisfied required for the engine to start. As a result of the experiment, it was found that the degree of satisfaction in the time taken for the power storage spring to store power sufficient to start the engine after the depression of the start switch of the electric motor, varied operator to operator; however, there was widespread dissatisfaction outside a certain range of time taken for a starting operation. Since the engine start device in the patent document 5 is provided with the buffer/power storage section, the lowest limit of the time required for the staring operation cannot be inevitable even thought this time is short. If the time taken for the starting operation is longer than an expected time, operators may feel irritated.

In patent document 3, a reduction ratio as extremely high as 1/250 to 1/300 is set in order to increase the torque of the electric motor. However, such high reduction ratios significantly increase time taken to store the required power in the spring barrel by rotating the spring barrel. In order to prevent dissatisfaction with the longer starting time of the engine, the engine start device in the patent document 3 incorporates an automatic wind type control device for the spiral spring; using the control circuit of the control device, the power of the power storage spring is automatically stored even after the engine is started by the starting operation performed every time; the timer or the degree to which the spiral spring has been wound is detected; and the supply of power to the motor is stopped, thereby shortening the waiting time required to restart the engine. This makes the entire device more complex, leading inevitably to cost increases.

The present invention has been proposed to overcome the conventional problems discussed above. It is accordingly an object of the present invention to provide a start device for small-sized engine designed such that using the advantageous effects of the start device for small-sized engine proposed in the patent document 5, an objectively appropriate range of starting times within which operators are satisfied is set, and to provide a manual work machine having this start device mounted thereon.

Means for Solving the Problems

It is found from an experiment conducted by the inventors that the appropriate range of time required to start the engine from the start of an electric motor is as extremely short as 0.4 to 1.3 seconds. 0.4 seconds, which is the lower limit of the range of time, is the time required to transmit the power of the electric motor to a power transmitting section via a buffer/power storage section. On the other hand 1.3 seconds, which is the upper limit of the range of time, is the time required to start the engine, to extend beyond which may irritate operators due to longer starting times. Such dissatisfaction affects the operations of the work machines and must be avoided for safety reasons.

Extremely small reduction ratios can be set compared to conventional ones by combining a small battery of high performance and large discharge capacity and a small-sized electric motor of large capacity and by providing a buffer/power storage section that has an appropriate springing force. This ensures smooth, secure transmission of power from the electric motor to the buffer/power storage section. As is apparent from the descriptions above, these extremely small reduction ratios have a direct relation with the starting time of the engine.

According to the present invention, there is provided a start device comprising: a small-sized electric motor which is driven by a battery, a buffer/power storage section to which output of the small-sized electric motor is drive-transmitted in a direction of force storage while stored power is buffered via a speed reduction mechanism, and a power transmitting section which transmits power stored in the buffer/power storage section to a crankshaft of an engine. The start device is characterized in that: a reduction ratio of the speed reduction mechanism is in a range of 1/30 to 1/90; and a range of time required to start the engine from a start of the small-sized electric motor is set to be in a range of 0.4 to 1.3 seconds.

Incidentally, according to a preferred aspect, the battery pack is extremely small and lightweight with a volume of $5.5\times10^4$ to $1.0\times10^2$ $mm^3$ and a weight of approximately 80 g. On account of such dimensions, the battery pack may be directly incorporated in the casing of the engine start device but may be accommodated outside of the casing, as in the switch box of the handle of a work machine.

A preferred small-sized electric motor is such that the volume of the housing is, for example, from $4.0\times10^3$ to $8.0\times10^4$ $mm^3$, a stalling current is from 1 to 100 A, a stalling torque is from 10 to 500 mNm, further, the output shaft of the small-sized electric motor and the rotation shafts of the rotating power storage section and power transmitting section are parallel to the direction of the engine gravity, and the output shaft and the rotation shafts are connected via the speed reduction mechanism. In addition to lithium secondary batteries (including at least two cells), an ordinary self-discharge prevention circuit and over-current prevention circuit connected to the secondary batteries, the battery pack incorporates a protection circuit comprising electronic circuits such as an over-charge prevention circuit, an over-discharge restraining circuit, and a start switch relay circuit.

In work machines mounting such start devices for small-sized engine, the engines are desirably provided with an electric dynamo for charging the lithium secondary batteries. The electric dynamo has a magnet disposed in the rotating part of the engine, and an electricity generating coil disposed opposite the magnet. It is preferable that the rotating part of the engine be a fan fixed to a crankshaft. This yields some advantageous effects.

Effects of the Invention

The discharging capacity of the entire battery according to the present invention satisfies discharge capacity required to drive at least an engine starting electric motor, a battery protection circuit, an electronic circuit, and a solenoid valve for a carburetor with an auto-choke. Owing to this, the battery uses, for example, lithium secondary batteries. The discharging capacity of each secondary battery is 1000 mAh. The output voltage of each of its cells is 3.8V. Accordingly, even if the discharge current for an electric motor for a starting engine is set to from 10 to 60 A, an output of 7.6 V produced by using two cells ensures sufficient capacity for a power source used to drive the other circuits. It is preferable that the lithium secondary batteries for use as a power source for a start device for small-sized engine mounted on work machines have a capacity sufficient to start the engine via a buffer/power storage section.

In order to drive an engine starting electric motor with predetermined capacity and torque, by providing a buffer/power storage section capable of storing the output capacity and power of the electric motor while buffering them, torque sufficient to rotate the buffer/power storage section can be secured, thus enabling the buffer/power storage section to securely and quickly accumulate power sufficient to start the engine using a speed reduction mechanism set to a reduction ratio of from 1/30 to 1/90, which is higher than conventional ones. Such reduction ratios make it possible to securely start the engine in an extremely short time of 0.4 to 1.3 seconds.

Where the battery pack is accommodated in a switch box, disposing the battery pack away from the engine is effective to improve vibration resistance and heat resistance. Additionally, disposing the battery pack away from a gasoline tank ensures safety and facilitates battery replacement. Like the engine start device in the patent document 5, the present invention not only obviates the need for a recoil type driving section but also greatly reduces the external dimensions and, hence, weight of the start device.

In work machines mounting these start devices for small-sized engines, it is preferable that the engines be provided with an electric dynamo for charging the lithium secondary batteries. The electric dynamo has a magnet disposed in the rotating part of the engine, and an electricity generating coil disposed opposite the magnet. Utilizing the rotation of the fan (serving as the rotating part of the electric dynamo) fixed to a crankshaft not only realizes a simple structure in which the magnet is simply attached to the fan, but also ensures efficient power generation by utilizing engine rotation. Utilizing this power generation in order to charge the lithium secondary batteries incorporated in the battery pack prevents insufficient charging of the battery.

DESCRIPTION OF THE REFERENCE NUMERALS

Figure 1:
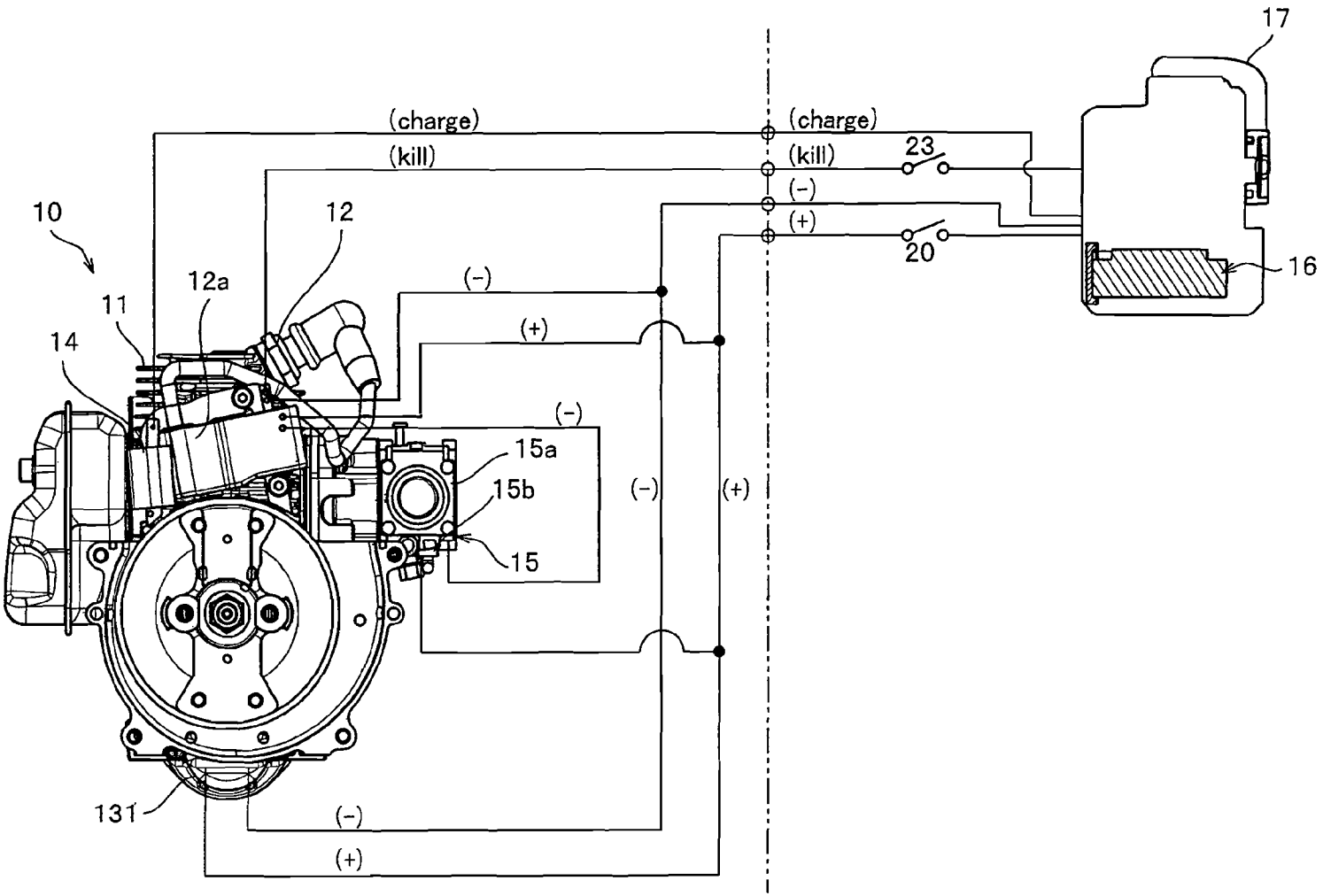
FIG. 1 is a diagram representing the wiring between the start device for small-sized engine and battery pack according to the present invention.

10 engine
11 cylinder
12 ignition plug
12*a* ignition coil
14 charging coil
15 carburetor with auto-choke
15*a* carburetor
15*b* choke coil
16 battery pack
17 switch box
20 start switch
23 engine stop switch
25 crankshaft
26 engagement pawl
27 crank case
28 bolt
100 engine start device
110 buffer/power storage section
111 spiral spring
111*a* inside end
112 spring barrel
113 peripheral spur gear
114 one-way clutch
120 power transmitting section
121 starting pulley
121*a* shaft play insertion hole
121*b* spiral-spring-end fixing part
122 engagement member
122*a* end
123 ratchet teeth
130 electric driving section
131 extremely small-sized electric motor
132 speed reduction mechanism
132*a* planetary gear mechanism
132*b* spur gear
132*a*-1 to 132*a*-3 first to third internal gear
132*a*'-1, 132*a*'-3 projection
133 output shaft
133*a* engagement part
134 motor section storage case
134*a* cylindrical body
134*a*-1 fitting groove
134*b* bottom
134*c*, 134*d* projection
140 case
140*a* first case body (on the engine side)
140*b* second case body (on the counter-engine side)
141 window
142 motor section tightly fitting hole
143, 147 bolt insertion hole
144 screw hole
145 shaft
146 wrench insertion hole
149 push button
150 torsion spring

BEST MODE FOR CARRYING OUT THE INVENTION

Representative embodiments according to the present invention will hereinafter be described with reference to the accompanying drawings.

FIG. 1 is a diagram showing a starting circuit for a hybrid cell start device for a small-sized engine mounted on a work machine according to the present invention.

Figure 2:
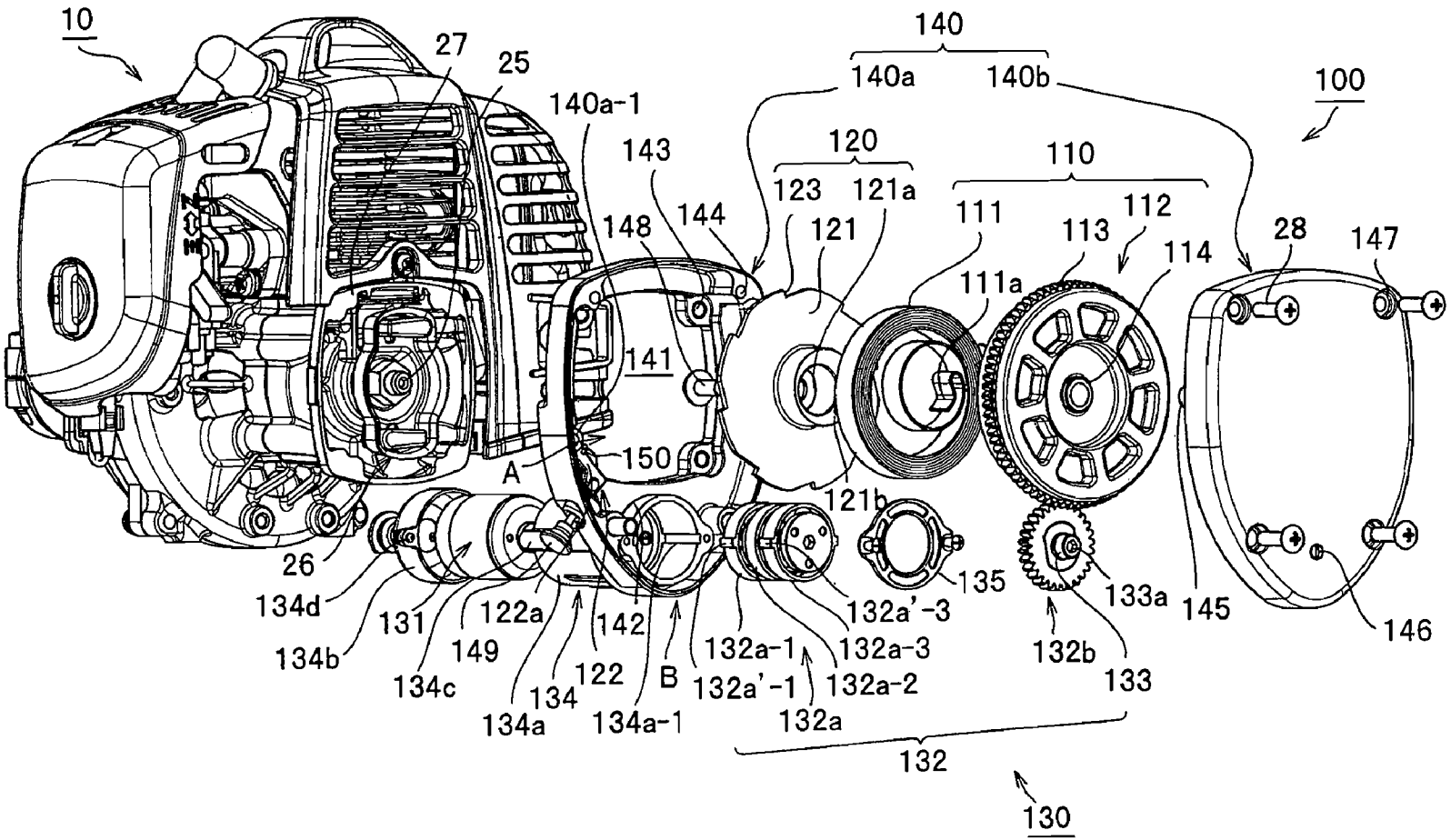
FIG. 2 is a diagram representing assembly of the start device for small-sized engine mounting the battery pack according to the present invention.

The small-sized engine 10 according to the present embodiment includes, as in conventional ones: a cylinder 11, an ignition plug 12 facing a combustion chamber for the cylinder 11; a piston (not shown); a crankshaft (not shown); a fan (not shown) fixed to the crankshaft; and a centrifugal clutch (not shown) disposed behind the fan (at the front in FIG. 2).

As shown in FIG. 1, in addition to the foregoing component devices, the small-sized engine 10 according to the present embodiment includes: an electric dynamo (not shown) for charging a battery (described below) that is the power source for driving an electric motor 131 used to start the engine; and a carburetor 15 with an auto-choke, for adjusting the air-fuel ratio when starting the engine. The electric dynamo includes: a first magnet (not shown) fixed to a part of the periphery of the fan; and a charging coil 14 disposed opposite the rotating face of the magnet. Attached to the carburetor 15 with the auto-choke is a solenoid valve (not shown). When the engine is stopped, the solenoid valve is closed because power has not been supplied to a choke coil 15*b*. However, simultaneous with a start switch being operated to start the engine, current flows in the choke coil 15*b* from a battery pack 16, thereby opening the solenoid valve. Depending on the amount by which the solenoid is opened or closed, the air-fuel ratio is controlled. According to the present embodiment, a temperature sensor (not shown) is disposed near the explosion chamber of the engine, thereby controlling the degree of opening of the valve based on the temperature measured by the sensor.

FIG. 2 shows assembly of the engine start device 100 (which has the connecting circuit described above) and small-sized engine 10 according to the present embodiment. That is, FIG. 2 is an explanatory view of the dispositions and structures of devices composing the engine start device 100 according to the present embodiment. This engine start device 100 may be used in a small air-cooled type gasoline engine or the like, and is disposed near the input end of the crankshaft 25 of the internal combustion engine 10.

As shown in FIG. 2, the engine start device 100 includes a buffer/power storage section 110, a power transmitting section 120, and an electric driving section 130, all of which are fitted together into one unit and accommodated in a single case 140. The upper half of the case 140 is a first space A of rectangular shape, in which the power storage section 110 and power transmitting section 120 are accommodated. The lower half of it is a second space B of inverted triangular shape, gradually narrowing toward the lower end, in which the driving section 130 is accommodated. The structure of the case 140 is divided into half: one is a first case body 140*a* on the engine side and the other, a second case body 140*b* on the counter-engine side.

Formed in the upper half of the first case body 140*a* on the engine side is a window 141. Formed in the middle of the lower half of the case body 140*a* is a motor-section tightly fitting hole 142 in which a speed reduction mechanism 132 (described below), one of the members composing the above-mentioned electric driving section 130, is fitted and supported. Bolt insertion holes 143 for fixing the first case body 140*a* to the engine 10 are formed inside the four corners of the rectangular window 141. Additionally, in the four parts (upper two corners and lower two corners) of the frame of the rectangular window 141, screw holes 144 for connecting the second case body 140*b* are formed. On the other hand, in the middle of the internal wall of the bottom (defining the first space A) of the second case body 140*b* on the counter-engine side, a shaft 145 projects toward the engine. Formed vertically below the shaft 145 and in an area (corresponding to the center of the motor-section tightly fitting hole 142) of the rear wall defining the second space B is a wrench insertion hole 146 communicating with the space inside. Bolt insertion holes 147 are also formed in areas (corresponding to the screw holes 144 of the first case body 140*a*) of the second case body 140*b*.

As shown in FIG. 2, the buffer/power storage section 110 includes a spiral spring 111 and a spring barrel 112. On one half of the periphery of the spring barrel 112 is a spur gear 113 formed along the circumference. Formed in the center of the spring barrel 112 is a through-hole, in which the outer ring of a one-way clutch 114, in the form of a bearing, is tightly fitted and fixed. The shaft 145 of the second case body 140*b* is pressed and fixed into the inner ring of the one-way clutch 114. Further, defined on the engine side of the spring barrel 112 is a spring accommodating space (not shown). Formed in part of the peripheral wall defining the spring accommodating space is an outside-end fixing groove (not shown) engaging with and fixed to the outside end of the spring 111.

The power transmitting section 120 includes a starting pulley 121 and an engagement member 122, which engages with or disengages from the starting pulley 121. Formed in the center of the starting pulley 121 is a play insertion hole 121*a*, in which a shaft 145 projecting from the second case body 140*b* may be inserted so as to have play. In the counter-engine side center of the starting pulley 121 is a spiral-spring-end fixing part 121*b* projecting toward the spring barrel 112 and defining the play insertion hole 121*a*. Formed in the spring-end fixing part 121*b* is an inside-end fixing groove engaging with and fixed to the inside end 111*a* of the spiral spring 111. Formed in the leading end of the shaft 145 is a screw hole (not shown). A screw 148 is screwed into this hole when assembly is complete. Thus, the buffer/power storage section 110 and the starting pulley 121 are accommodated and fixed in the second case body 140*b*.

Disposed in the engine side center in the starting pulley 121 is an engagement projection (not shown) that has, on its periphery, ratchet teeth engaging with an engagement pawl (not shown) that is an element of a centrifugal clutch mechanism mounted on the crankshaft 25 of the engine 10. This engagement projection receives energy of a releasing direction produced in the process of storing springing force in the spiral spring 111 as a result of the rotation of the spring barrel 112. Simultaneous with this, while engaging with the engagement pawl 26 of the crankshaft 25, the engagement projection remains stationary until the power exceeds the maximum load of the engine. When the power stored in the spiral spring 111 exceeds the maximum load of the engine, the starting pulley 121 starts rotation, with the engagement projection fitting together with the engagement pawl 26. Thereby the engine starts. When the engine rotation becomes constant, the engagement pawl 26 disengages from the engagement projection of the starting pulley 121 on account of the centrifugal force of the engine. Thereby the engine is allowed to continue rotation.

Further, ratchet teeth 123 are formed at predetermined intervals on the periphery of the starting pulley 121 and thus the entire starting pulley 121 composes a ratchet wheel. One end 122*a* of the engagement member 122 is supported by the boss 140*a*-1 of the first case body 140*a* so as to rotate freely. Using the push button 149, the leading end of the engagement member 122 engages or disengages with the ratchet teeth 123 on the periphery of the starting pulley 121, thereby permitting or inhibiting rotation of the starting pulley 121. The leading end of the engagement member 122 is pressed by a torsion spring 150 so as to disengage from the ratchet teeth 123 when the engine starts normally. By rotating the end 122*a* of the engagement member 122 against the pressing force applied by the torsion spring 150, the leading end thereof engages with the ratchet teeth 123.

As shown in FIG. 2, a ball (not shown) at the leading end of the pin of a push button 149 attached to part of the peripheral wall of the first case body 140*a* fits into the leading end of the engagement member 122. According to the present embodiment, in order to rotate the leading end of the engagement member 122 against the pressing force applied by the torsion spring 150, the push button 149 is pushed, thereby rotating the engagement member 122 toward the ratchet teeth 123 against the pressing force. The push button 149 is locked by a locking means (not shown) by being pushed in just such a manner. The push button 149 is unlocked by its being pulled and, consequently, the engagement member 122 rotates in the direction of disengagement from the ratchet teeth 123. Further, the engagement member 122 is fixed to the peripheral wall of the first case body 140*a* by the pressing force applied by the torsion spring.

The electric driving section 130 includes; the above-mentioned electric motor 131 for starting the engine, and the speed reduction mechanism 132 connected to the output shaft of the electric motor 131. The high speed rotation of the electric motor 131 is reduced via the speed reduction mechanism 132, and the reduced rotation is transmitted to the spring barrel 112. The speed reduction mechanism 132 includes a small planetary gear mechanism 132*a*, and a spur gear 132*b* fixed to the output shaft of the planetary gear mechanism 132. Since the speed reduction mechanism 132 is formed from the planetary gear mechanism 132*a* and spur gear 132*b* in combination, the input part and output shaft of the mechanism 132 can be disposed on a common first axis, thus making it possible to dispose the axis parallel to the above-mentioned shaft 145 projecting toward the engine from the second case body 140*b*.

Further, in the present embodiment, as shown in FIG. 2, the first axis of the electric driving section 130 is disposed substantially perpendicularly to and below a second axis coinciding with the central line of the shaft 145. This eliminates the need for a recoil mechanism. This also reduces the length of the case 140 in the axial direction and minimizes the width of the case 140 by disposing a battery, which is conventionally disposed below the buffer/power storage section 110 and power transmitting section 120, inside a switch box 17 (see FIG. 1) disposed outside the case 140 and mounted on, for example, an operating handle (not shown) of the work machine, and by disposing the electric driving section 130 in an empty space in the switch box 17.

The planetary gear mechanism 132*a* according to the present embodiment includes the first to third internal gears 132*a*-1 to 132*a*-3, which are ring-like sun gears. The planetary gear mechanism 132*a* is accommodated and fixed in the motor section storage case 134 together with the electric motor 131. Formed on the peripheries of the first and third internal gears 132*a*-1 and 132*a*-3 are projections 132*a*'-1 and 132*a*'-3 extending parallel to the rotation axis. Formed in the internal face of the motor section storage case 134 are fitting grooves 134*a*-1 extending parallel to the axes of the corresponding projections 132*a*'-1 and 132*a*'-3 and receiving these corresponding projections 132*a*'-1 and 132*a*'-3.

In the present embodiment, the motor section storage case 134 includes a bottomed cylindrical body, which is open on the side opposite the engine and is sectioned into a cylindrical body 134*a* and a bottom 134*b*. Formed on the peripheral faces (having the fitting grooves 134*a*-1) of the cylindrical body 134*a* and bottom 134*b* are projections 134*c* and 134*d* respectively extending parallel to the first axis. A screw hole is formed in the projection 134*d* of the bottom 134*b*, and a bolt insertion hole is formed in the projection 134*c* of the cylindrical body 134*a*. The projections 132*a*'-1 and 132*a*'-3 of the planetary gear mechanism 132*a* fit in the corresponding fitting grooves 134*a* of the motor section storage case 134 of the foregoing configuration, and thus the electric motor 131 and the planetary gear mechanism 132*a* are accommodated and fixed in the motor section storage case 134. The motor section storage case 134 accommodating the electric motor 131 and planetary gear mechanism 132*a* is tightly fitted and supported in the motor-section tightly fitting hole 142 formed in the first case body 140*a*. In this case, the electric motor 131 and planetary gear mechanism 132*a* accommodated in the motor section storage case 134 are fastened and fixed in the fixing frame 135 by bolts and nuts (not shown) so that the output shaft of the planetary gear mechanism 132*a* is exposed outside. The spur gear 132*a* is fixed to the leading end of the output shaft of the planetary gear mechanism 132*a* thus accommodated and fixed in the motor-section accommodating case 134.

Figure 3:
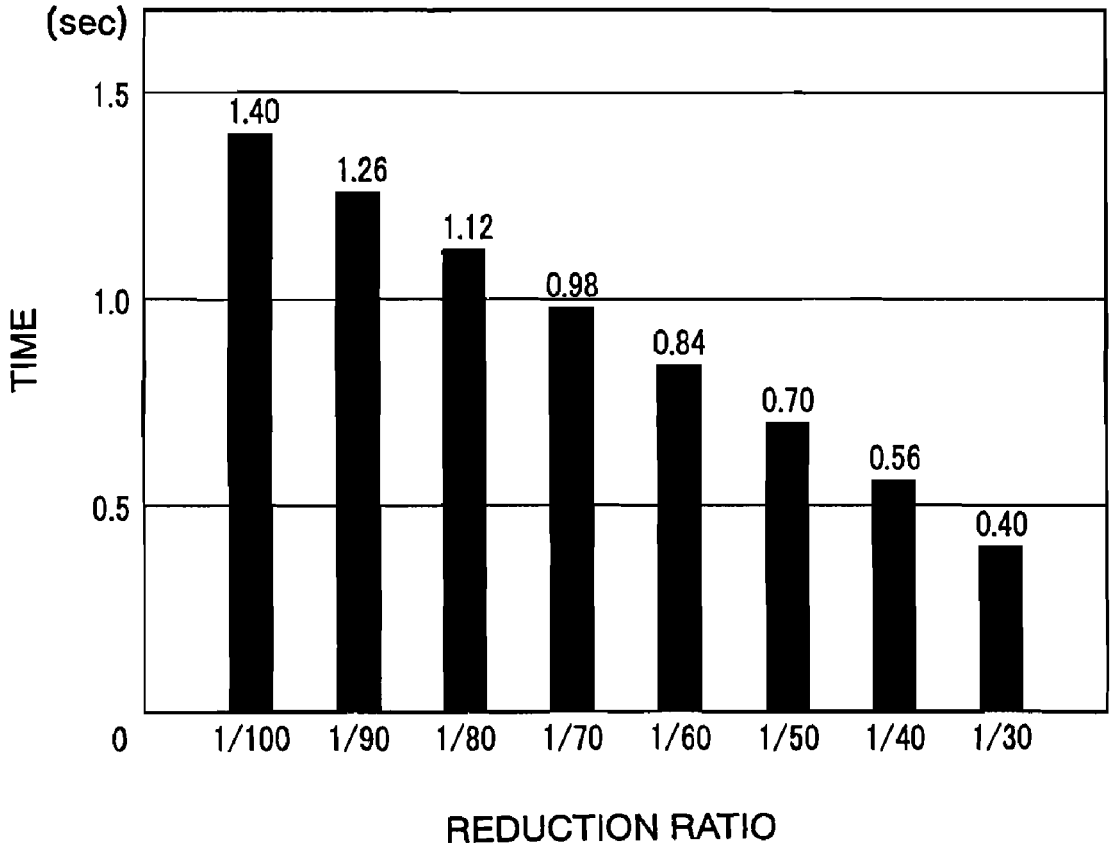
FIG. 3 is a diagram representing the interrelations between the reduction ratios of the start device for small-sized engine according to the present invention and the times taken for the engine to start.

According to the present invention, the reduction ratio of the small-sized electric motor 131 to the buffer/power storage section is set to from 1/30 to 1/90. FIG. 3 shows the result of a test conducted by the inventors of this invention. Specifically, FIG. 3 is a diagram representing the interrelations between the various reduction ratios and times taken for the engine to start after the electric motor is started at these reduction ratios. The test was conducted by setting eight reduction ratios (1/30, 1/40, 1/50, 1/60, 1/70, 1/80, 1/90, and 1/100) and using small-sized engines incorporating engine start devices with the above-described configuration according to the present invention, which were made on an experimental basis. Each of eighty-three tested operators who were used to start this type of engine started the engine using the start device at a given reduction ratio. In this case, in order that power is transmitted from the electric motor 131 to the buffer/power storage section 110 via a power transmission system including the speed reduction mechanism, it takes at least 0.4 seconds for the engine to start after the electric motor 131 is actuated. For this reason, the upper limit of the reduction ratio according to the present invention was set to 1/30.

Figure 4:
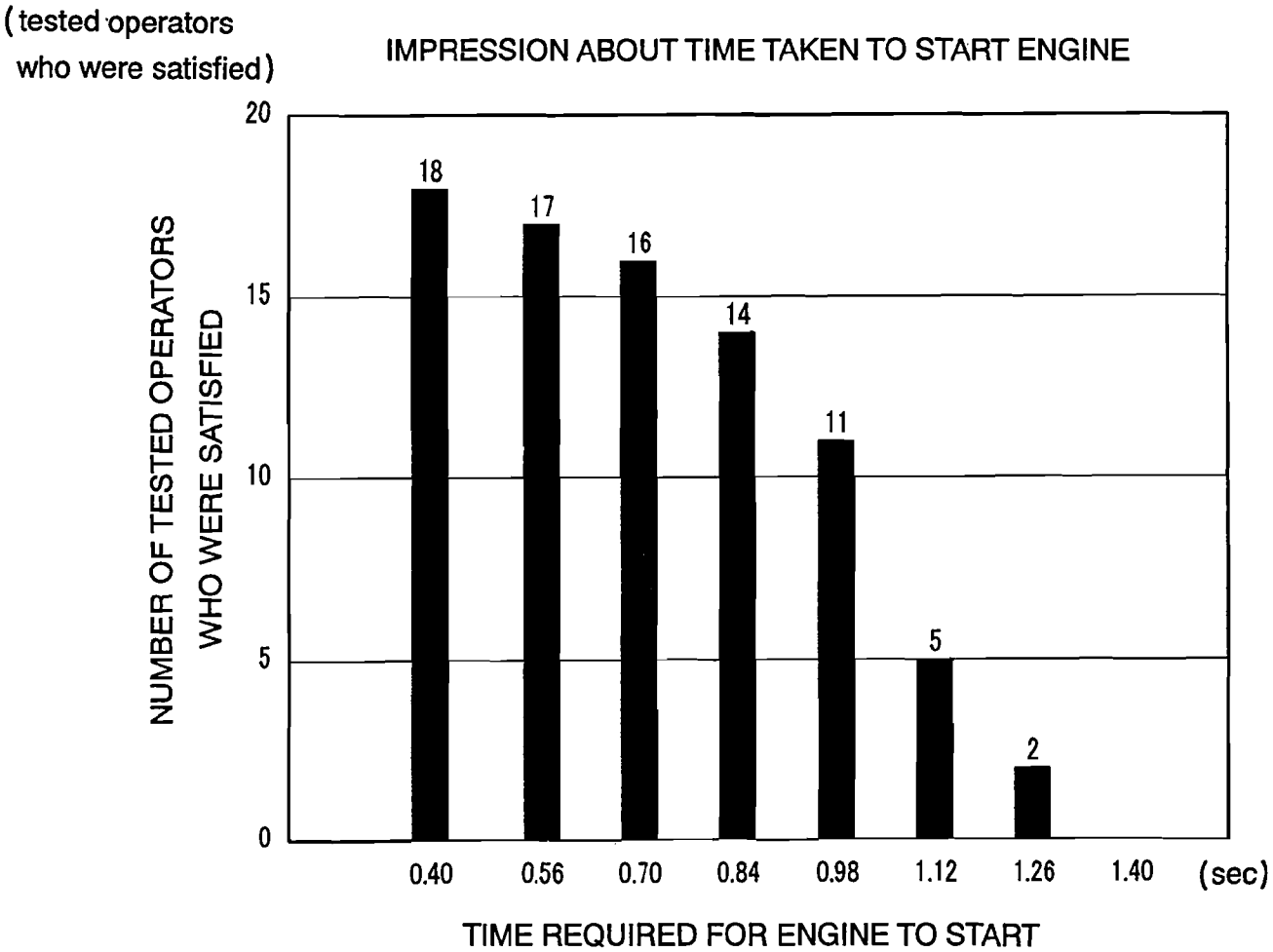
FIG. 4 is a diagram representing the interrelations between the degrees of satisfaction of operators who started the engine and the times taken for the engine to start.

Times required for the engine to start at the eight corresponding reduction ratios were approximately (as shown in FIG. 3) 0.40 seconds, 0.56 seconds, 0.7 seconds, 0.84 seconds, 0.98 seconds, 1.12 seconds, 1.26 seconds, and 1.4 seconds. FIG. 4 shows the result of the interrelations between the times required for the corresponding engines to start and the number of tested operators who answered that the corresponding times were favorable when asked about the impression about time taken to start the engines. As is apparent from this diagram, the operators are not dissatisfied, in particular, if the engine starts approximately within the range of 0.4 to 1.3 seconds after the electric motor 131 starts. However, where it took 1.4 seconds for the engine to start, no one was satisfied. Taking the results of this test into consideration, the reduction ratio according to the present invention has been set to from 1/30 to 1/90.

According to the present invention, the reduction ratio of the small-sized electric motor 131 to the spring barrel 112 has been set to 1/50. The reduction ratio of the spur gear 132*b* (which is fixed to the output shaft of the planetary gear mechanism 132*a*) to the spur gear 113 (which is formed on the periphery of the spur barrel) has been set to 1/2.5. For this reason, the reduction ratio of the planetary gear mechanism 132*a* has been set to 1/20. Formed on the output shaft 133 of the planetary gear mechanism 132*a* (i.e., the end of the support shaft of the spur gear 132*b*) is an engagement part 133*a* capable of engaging with, for example, a hexagon wrench (not shown). On the axis of the engagement part 133*a* is the center of the wrench insertion hole 146 formed in the rear wall of the second case body 140*b*.

To assemble together the composing members of the foregoing structures according to the present embodiment so that the engine start device is accommodated in the case 140, the shaft 145 of the second case body 140*b* is pressed and fixed into the through-hole of the spring barrel 112 in which the one-way clutch 114 has been tightly fitted. At this time, the outside end of the spiral spring 111 is engaged with and fixed in the outside-end fixing groove (not shown) formed in the peripheral wall defining the spring accommodating space of the spring barrel 112. Subsequently, the inside end of the spiral spring 111 is engaged with and fixed into the inside-end fixing groove of the spring-end fixing part 121*b* formed at the center of the starting pulley 121. Then, the shaft 145 of the second case body 140*b* is inserted into the play insertion hole 121*a*, made through the spring-end fixing part 121*b* so as to have play. A fastening screw 147 is twisted into the screw hole of the leading end of the shaft 145 and thereby the spring barrel 1 and starting pulley 121 are fitted together so as to be accommodated in the second case body 140*b*.

To assemble the electric driving section 130 so as to be accommodated in the case 140, the DC electric motor 131 and the planetary gear mechanism 132*a* and spur gear 132*b* of the speed reduction mechanism 132 are fitted together into an assembly in advance. The projections 132*a*'-1 and 132*a*'-3 formed on the periphery of the planetary gear mechanism 132*a* of the assembly are fitted in and fixed in the fitting groove 142*a* of the internal face defining the motor-section tightly fitting hole 142 formed on the first case body 140*a*. Thereafter, the assembly is fastened to a crank case 27 by bolts 28 via four bolt insertion holes 143 formed inside the four corresponding corners of the rectangular window 141 of the first case body 140*a*. Simultaneous with this fastening action, the electric motor 131 is positioned in and fixed in a predetermined place in the crank case 27.

After the first case body 140*a* is fixed to the crank case 27 together with the electric driving section 130, bolts 28 are twisted into the screw holes 144 of the first case body 140*a* via the screw insertion holes 147 of the second case body 140*b*. Thereby, the second case body 140*b* with the buffer/power storage section 110 and power transmitting section 120 thus fitted together is fixed integrally to the first case body 140*a*. When the second case body 140*b* is fixed to the first case body 140*a*, the other rotating end 122*c* of the engagement member 122 is engaged with one of the ratchet teeth 123 formed on the periphery of the starting pulley 121. When the engagement member 122 is pivotally supported by the boss 140*a*-1, its leading end is pressed by the torsion spring 150 so as not to engage with any one of the ratchet teeth 123 unless the end 122*a* of the engagement member 122 is operated.

In the electric type engine start device 100 of the foregoing configuration according to the present embodiment, the need for a recoil type driving section and a battery, which have been conventionally disposed in the case 140, is eliminated as mentioned above. In addition, the spring barrel 112 accommodating the spiral spring 111 for the buffer/power storage section 110 and the starting pulley 121 for the power transmitting section 120 are supported on the common shaft 145. Disposed vertically below the shaft 145 and on the axis parallel to the shaft 145 are the electric motor 131 composing the electric driving section 130 and the planetary gear mechanism 132*a* and spur gear 132*b* composing the speed reduction mechanism 132. In addition, both the electric motor 131 and planetary gear mechanism 132*a* are of a very small type and can accordingly be accommodated in the case 140 compactly. This makes the case 140 itself and hence the entire start device far more compact.

To start the engine 10 by use of the start device 100, a start switch 20 on a handle is turned on, thereby actuating the electric motor 131. Consequently, the speed reduction mechanism 132 including the planetary gear mechanism 132*a* and spur gear 132*b* rotates the spring barrel 112 at a reduction ratio of 1/50 in the force storage direction of the spiral spring 111. At this moment, the engagement member 122 is not engaged with the starting pulley 121 of the power transmitting section 120. The engagement pawl 26 attached to the crankshaft 25 is, however, engaged with the engine side engagement projection of the starting pulley 121.

In the process of storing power in the spiral spring 111 after the rotation of the spring barrel 112, counter forces to release the stored power act on the spiral spring 111, thereby rotating the crankshaft 25 via the engagement pawl 26 and initiating compression of the engine 10. However, unless the stored power of the spiral spring 111 is sufficient to exceed the maximum load of compression, the crankshaft 25 will not rotate at a speed sufficient to initiate the compression. Conversely, when the spiral spring 111 accumulates power beyond the maximum load of compression of the engine 10, the force to release the stored power of the spiral spring 111 exceeds. Consequently, the starting pulley 121 rotates the crankshaft 25 via the engagement pawl 26, and the engine 10 ignites and starts to rotate. According to the present embodiment, the time taken for the engine 10 to start after the actuation of the electric motor 131 is only 0.7 seconds.

When the rotation of the engine 10 becomes constant, the engagement pawl 26 and the engagement projection of the starting pulley 121 disengage from each other on account of the centrifugal force of the engine, allowing the engine to continue to rotate. At this time, the time required for the engine 10 to start is extremely short since the reduction ratio of the speed reduction mechanism has been set to 1/50, which is extremely small, in addition to the battery specific to the present invention. Accordingly, the time required to start the engine 10 is substantially the same as that required to start a regular cell start device used in a vehicle, etc.

As shown in FIG. 1, when the start switch 20 is turned on, the starting electric motor 131 is subject to discharge via an over-discharge restraining circuit for use as a battery protection circuit, thereby starting the electric motor 131. Simultaneously, if a temperature sensor (not shown) determines that the temperature of the surroundings of the explosion chamber of the engine is below a predetermined temperature, an air/fuel ratio control circuit is actuated. As a result, electric current flows in the choke coil 15*b* of the carburetor 15 equipped with an auto-choke, and the solenoid valve (not shown) disposed in the intake passage of the carburetor 15*a* opens, thereby increasing fuel supplied to the small-sized engine 10. If the surroundings of the explosion chamber of the engine 10 are above the predetermined temperature, a shut-off circuit (not shown) stops an electric current from flowing into the choke coil 15*b*, and keeps the solenoid valve closed. The driving current for the solenoid valve at this time is 200 to 800 mA at most. This driving current is also supplied from the battery pack 16.

Figure 5:
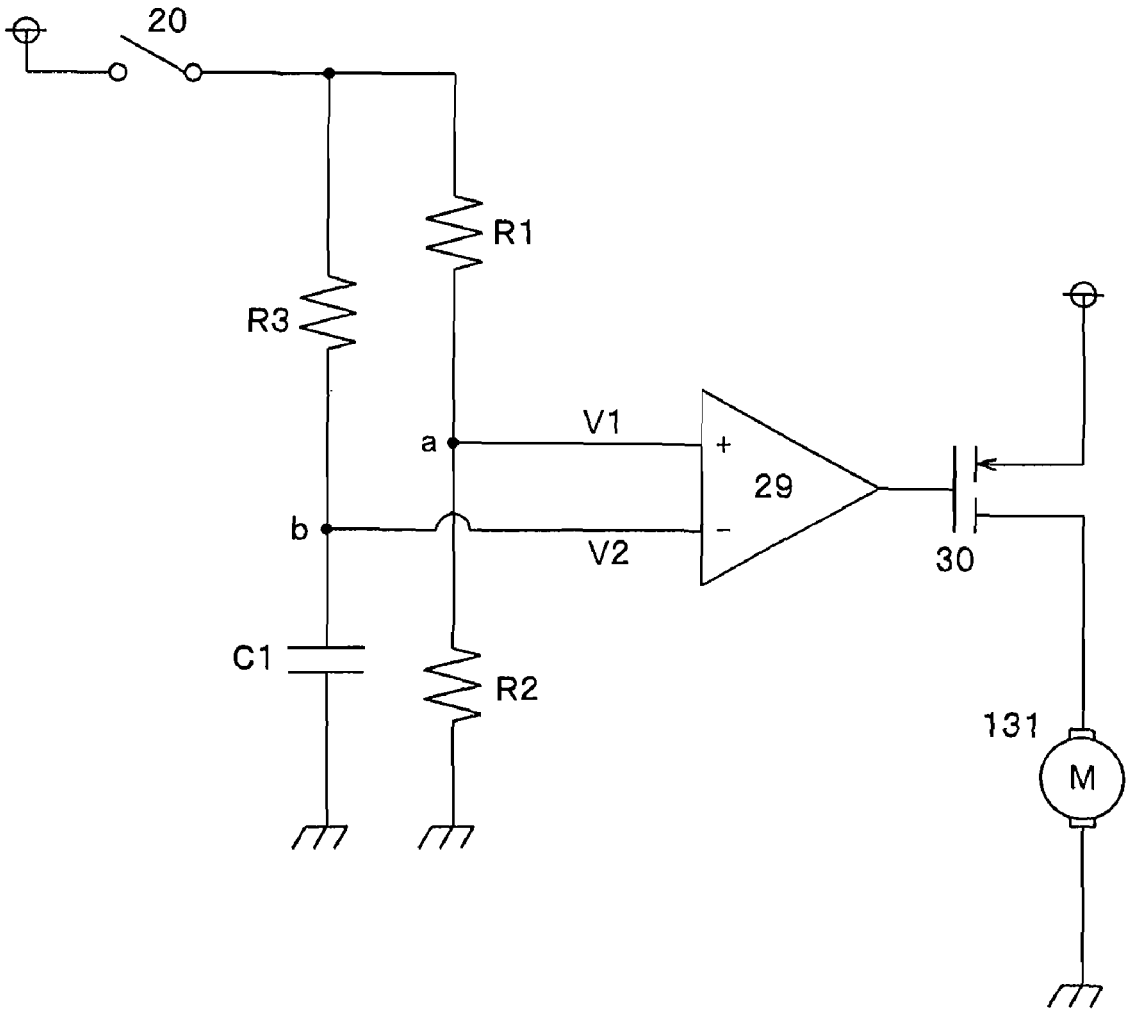
FIG. 5 is a diagram representing a circuit of an example of a typical over-discharge restraining circuit, which is one of protection circuits provided in the battery pack according to the present invention.

The basic function of the over-discharge restraining circuit is as follows: the time sufficient to securely start the small-sized engine 10 with the electric motor 131 described above is preset; when the preset time has elapsed after the start of the electric motor 131, the driving circuit of the electric motor 131 is automatically shut off, thereby stopping the electric motor 131. FIG. 5 shows an example of a typical timing circuit that incorporates a capacitor composing the over-discharge restraining circuit A according to the present embodiment. The over-discharge restraining circuit A, needless to say, is not limited to the timing limit circuit shown in FIG. 5. The over-discharge restraining circuit may be disposed together with an over-heat prevention circuit. Such an over-heat prevention circuit may be designed as described below. The inside temperature of the battery pack 16 is measured and, when the measured value exceeds a preset temperature, a start switch may automatically open, thereby stopping discharge. Alternatively, an electric current value flowing in the starting electric motor 131 is subject to the calculation of integration using time, the value of the result is converted to a quantity of heat, and when the quantity of heat exceeds a set value, discharge may automatically be stopped. Otherwise, when the number or revolutions of the motor exceed a set value, discharge may automatically stop.

In FIG. 5, if the start switch 20 of the electric motor 131 is turned on, a voltage V1 is produced at point (a). A voltage V2 at point (b) continues to rise during the charging of the capacitor C. When voltages V1 and V2 become equal at this time, an AND circuit 29 transmits a signal. Consequently the electronic switch 30 opens which has been closed previously, thereby stopping the electric motor 131. In this case, the time T taken for the electric motor 131 to stop from its start is determined by the capacity of the capacitor C.

Figure 6:
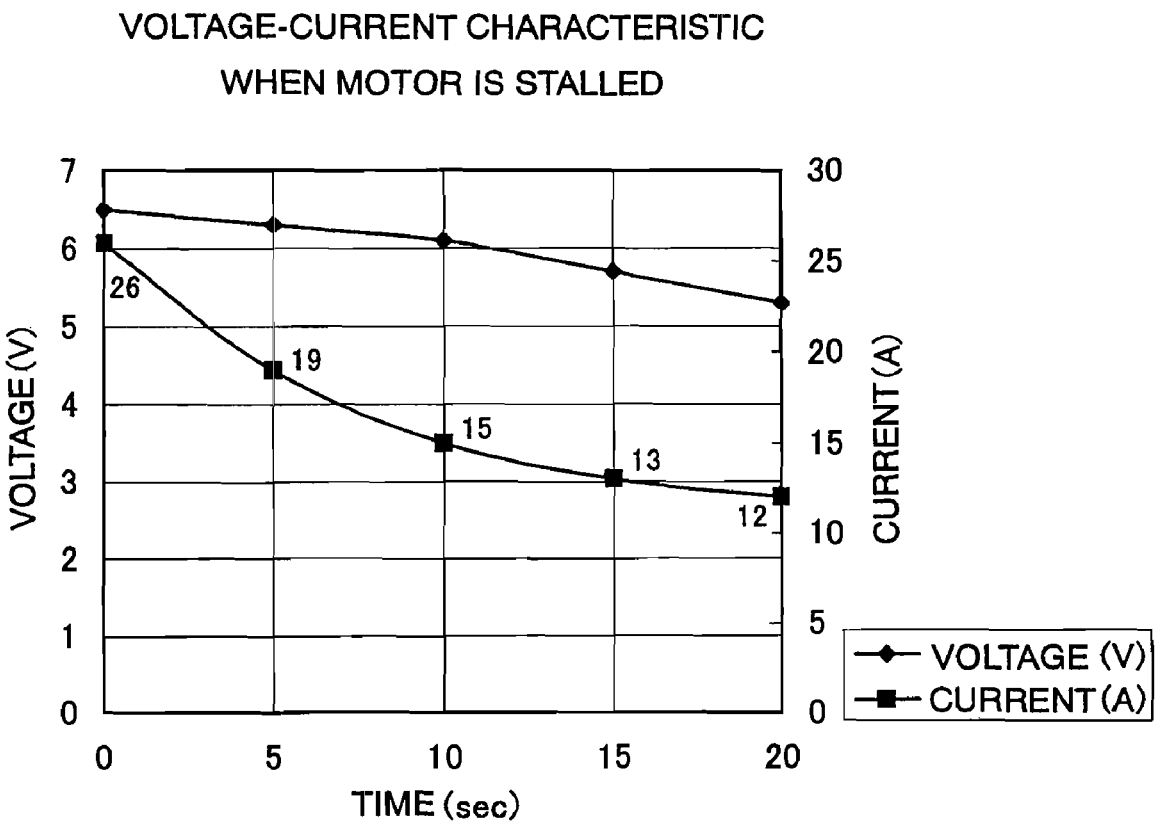
FIG. 6 is a diagram representing voltage-current characteristics when a motor is stalled.
Figure 7:
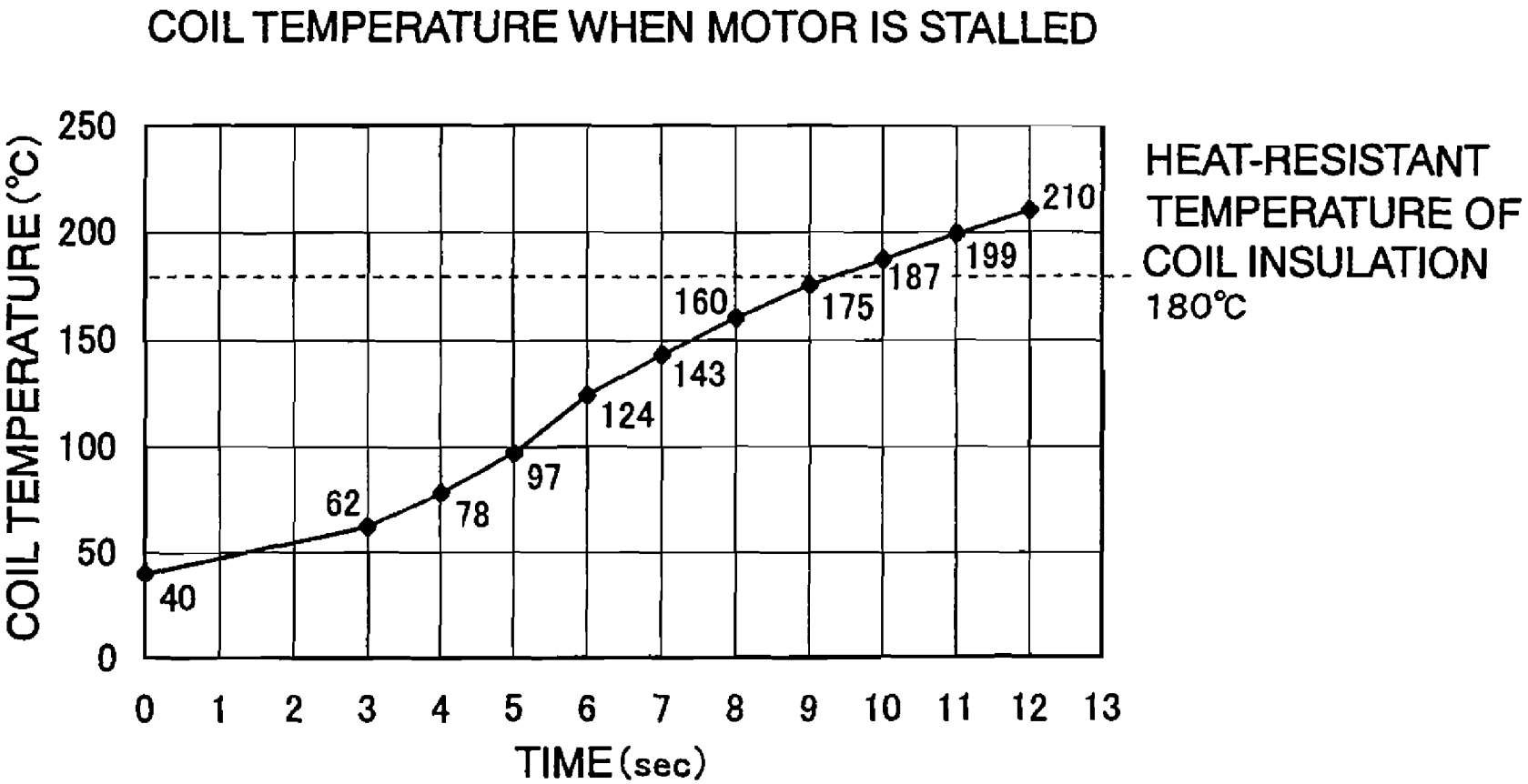
FIG. 7 is a diagram representing a temperature characteristic, which is an example of the coil temperature characteristic when the motor is stalled.

In the present embodiment, driving time T for the electric motor 131 has been set to 10 seconds. If the start switch 20 is turned on, with the electric motor 131 stalled, and a current of 26 A is caused to flow in a motor driving circuit from the battery pack 16, the circuit in the battery pack 16 may overheat. As a result, some circuit elements may burn and subsequently damage the circuit. In addition, if the coil temperature exceeds a certain level, the electric motor 131 may be burned, resulting in rotation that is not smooth. FIGS. 6 and 7 show the result of an experiment conducted to discover the interrelations between the driving time, voltage and current.

A current of 26 A is caused to flow in the stalling electric motor 131 for 15 min from the battery pack fully charged (8.4V) with the electric motor 131 stalled. As shown in FIG. 6, both the voltage and current decrease with time. FIG. 7 is a diagram showing a change in the coil temperature when a current is caused to flow in the electric motor 131 for 12 seconds under the same conditions as those in FIG. 6. In this type of electric motor, the limit of the heat-resistant temperature of an insulation film covering the coil surface is normally 180° C. As is understood from FIG. 7, the coil temperature reaches 187° C. 10 seconds after the current is caused to flow in the electric motor 131, and this value is greater than the heat-resistant temperature of the insulation film.

In the present embodiment, a small-sized electric motor that is greater in output and capacity than conventional ones despite its compact size is used; moreover, the buffer/power storage section is disposed between the electric motor and the power transmitting section that moves in synchronization with the movement of the crankshaft of the engine, and the speed reduction mechanism is disposed between the electric motor and the buffer/power storage section. This makes it possible even for the small-sized electric motor to transmit sufficient torque to the buffer/power storage section at a reduction ratio that is as low as 1/30 to 1/90. Accordingly, power sufficient to start the engine can securely be accumulated. In addition, the reduction ratio in this range makes it possible to start the engine in an extremely short time, such as from 0.4 seconds to 1.3 seconds, to start the engine after the actuation of the electric motor. Accordingly, within this range of time, an operator starting the engine is not dissatisfied.

Also, the rational design in which the axes of the electric motor and speed reduction mechanism and the axes of the buffer/power storage section and power transmitting section are parallel in the direction of the engine gravity reduces the length and width of the engine start device. Such a rational design and small-sized electric motor make the start device more compact while preventing the engine from losing its sideways balance due to the start device attached to the engine.

The invention claimed is:

1. A manual work machine mounting a start device for a small-sized engine, the manual work machine comprising:

a small-sized electric motor which is driven by a battery, a buffer/power storage section to which output of the small-sized electric motor is drive-transmitted in a direction of force storage via a speed reduction mechanism, and a power transmitting section which transmits power stored in the rotating power storage section to a crankshaft of an engine, wherein:

the small-sized electric motor and the speed reduction mechanism are arranged on a first axis line, the power transmitting section and the buffer/power storage section are arranged on a second axis line parallel to the first axis line, the first axis line is positioned vertically below and parallel to the second axis line, the first axis line defines a plane including both the first axis line and the second axis line, the work machine is balanced relative to a sideways direction when the plane surface is positioned parallel to a direction of gravity, the battery comprises at least one lithium secondary battery having a discharge capacity not less than 1000 mAh, the small-sized electric motor comprising a housing having a volume from $4.0\times10^3$ to $8.0\times10^4$ $mm^3$, a stalling current from 1 to 100 A, and a stalling torque from 10 to 500 mNm, a reduction ratio of the speed reduction mechanism is in a range of 1/30 to 1/90, and a range of time required to start the engine from a start of the small-sized electric motor is in a range of 0.4 to 1.3 seconds.

2. The manual work machine according to claim 1, wherein the start device further comprises an over-discharge restraining circuit operable to shut off a driving circuit of the small-sized electric motor after a predetermined driving period.

* * * * *